United States Patent [19]

Tjernström

[11] 4,154,215

[45] May 15, 1979

[54] AIR DAMPER FOR OPEN FIREPLACE

[75] Inventor: Lars Tjernström, Järved, Sweden

[73] Assignee: Impuls Innovation AB, Järved, Sweden

[21] Appl. No.: 819,859

[22] Filed: Jul. 28, 1977

[51] Int. Cl.[2] ..... F24B 1/18

[52] U.S. Cl. ..... 126/121; 126/120

[58] Field of Search ..... 126/120, 121, 123, 126, 126/129, 131, 132, 135, 140, 141, 142

[56] References Cited

U.S. PATENT DOCUMENTS

| | | | |
|---|---|---|---|
| 2,181,624 | 11/1939 | Maurer | 126/121 |
| 2,331,178 | 10/1943 | Dollinger | 126/121 |
| 3,096,754 | 7/1963 | Howrey | 126/121 X |
| 4,062,344 | 12/1977 | Mayes | 126/120 |

*Primary Examiner*—Dennis L. Taylor

*Attorney, Agent, or Firm*—Strauch, Nolan, Neale, Nies & Kurz

[57] ABSTRACT

An open fireplace with an air distribution system for heating one or more rooms and including a heat exchanger and an electric fan for forcing air through the heat exchanger thence through the air distribution system. Incorporated into the fireplace system is a flow control apparatus at the heating air outlet end of the heat exchanger providing fluid communication of heating air into the distribution system or through a by-pass communication back to the immediate area in which the heating air inlet to the heat exchanger is located. The flow control device includes a damper which is positioned in response to a heating air condition such as flow or temperature to divert heating air from the distribution system into the by-pass to avoid excessive air temperatures in the distribution system.

9 Claims, 5 Drawing Figures

AIR DAMPER FOR OPEN FIREPLACE

BACKGROUND OF THE INVENTION

Figure 1:
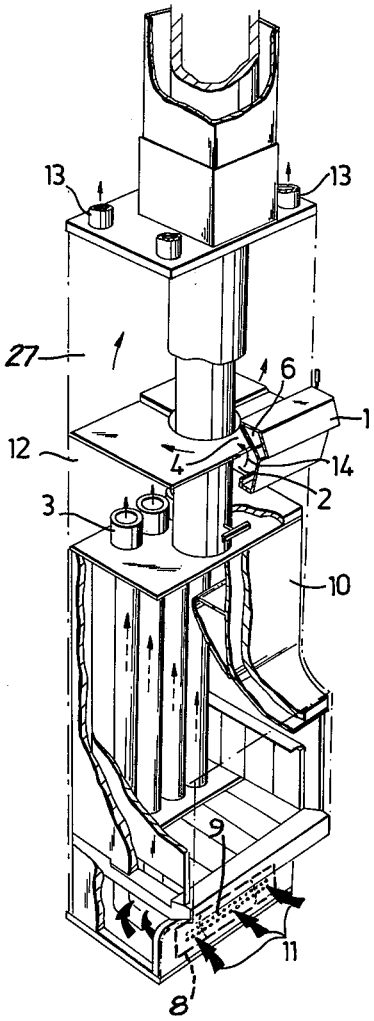

This invention relates to an air damper for an open fireplace of the type, at which heat exchange takes place between the heat generated in the fireplace and cooler air, and where said air in heated state is intended to be transported via a distribution system to one or several rooms to be heated.

In order to increase their efficiency degree, open fireplaces of different types have been provided with heat exchangers for the heating of air, which has a temperature lower than the desired room temperature. Distribution systems, furthermore, have been developed to transport the heated air to other rooms than the one where the fireplace is located, in order to heat said rooms. In apartments, thus, the heated air is passed through a ventilation system from fireplaces to the other rooms.

The highest efficiency degree of an open fireplace knowingly is obtained when the air to be heated is passed through the heat exchanger of the fireplace by means of a fan, preferably an electric one, whereby desired air amounts can be passed through the heat exchanger.

An open fireplace, which is dimensioned to be fan-operated and thereby to produce the maximum heating effect within the margins of reasonable safety with respect to air temperature in the distribution system, delivers air of a temperature preferably slightly below 80° C. In Sweden, the air temperature in the distribution passages is by regulations limited to 80° C. at maximum. In the event of current interruption during operation, however, with resulting shut-off of the fan, the air temperature increases very rapidly because the air flow through the heat exchanger is stopped. Due to the fact, that a highest permissible air temperature in the distribution passages (in Sweden 80° C.) during operation cannot be guaranteed, open fireplaces of the type here concerned could not be utilized to such an extent as motivated a.o. by its advantages with respect to fuel costs and high efficiency degree.

The present invention solves the aforesaid problems. It relates to an air damper for an open fireplace, which is designed so that heat exchange takes place between the heat generated in the fireplace and cooler air, which is passed through the fireplace by an electric fan and in heated state is transported in distribution passages to one or several rooms to be heated.

The invention is characterized in that the damper is positioned on the hot air side of said heat exchanger, and that the device comprises a rotatable metal sheet or the like constituting a damper, which is capable to assume a first and a second end position, and the damper in said second end position prevents the air stream from passing to the distribution passages and permits the air stream to pass on to the room where the open fireplace is located or into a space safe for high temperatures, and the damper in said first end position permits the air stream to pass out into the distribution passages and prevents the air stream from passing out into said last-mentioned room, and that the damper is adapted by action of a force to assume said second end position when there is risk of excess temperature in the distribution passages, which force arises when the function of said fan is disturbed so that the air temperatures in the device exceed a predetermined value.

Figure 2:
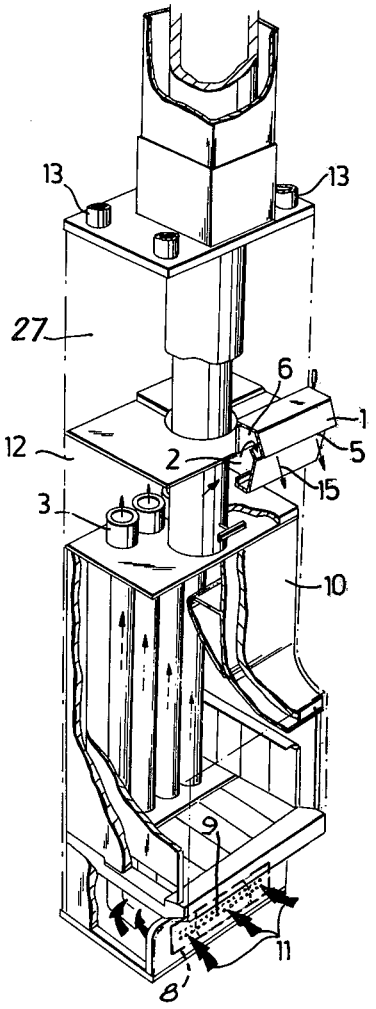
Figure 3:
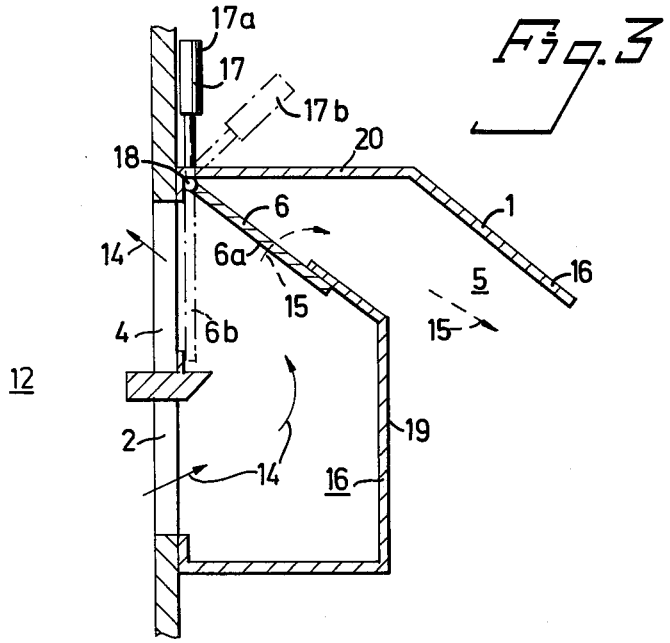
Figure 4:
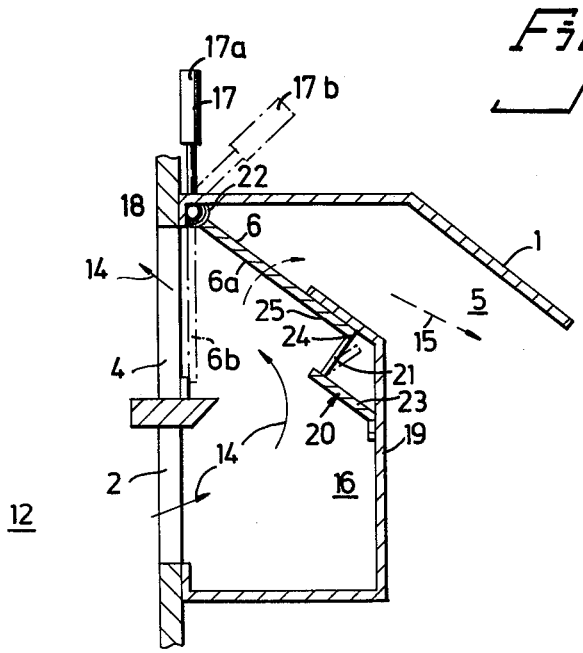
Figure 5:
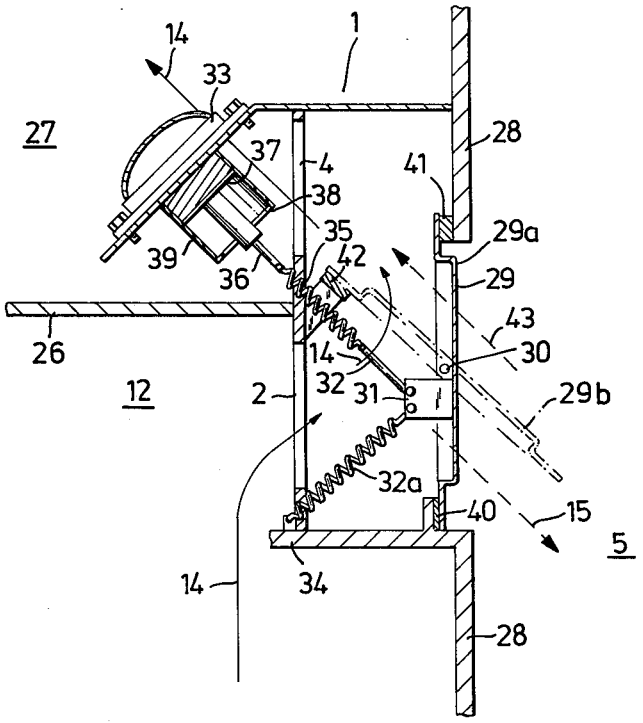

The invention is described below with reference to the accompanying drawing, in which FIGS. 1 and 2 schematically show an open fireplace, to which the device according to the invention is applied, FIG. 3 shows a first embodiment of the air damper according to the invention, FIG. 4 shows a second embodiment of the invention, and FIG. 5 shows a third embodiment of the invention.

In FIGS. 1 and 2 an open fireplace 10 comprising a heat exchanger and an electric fan (shown by schematic dotted lines) behind a heating air inlet 9 at the bottom of the fireplace for advancing the air to be heated is designated by. The air to be heated enters the fireplace as indicated by the arrows 11 and after heat exchange is transported into a plenum chamber which is hereinafter designated as room 12 from the outlet pipes 3 of the heat exchanger. At normal operation of the fan, the air flows from said room 12 through the flow control device according to the invention, which is generally designated by 1, and out into the distribution passages as indicated by the arrows 14. At unnormal operation of the fan, the air is passed from the room 12 into the room where the open fireplace is located, via an aperture 5 in the device 1 as shown by the arrows 15.

In FIG. 3 a first embodiment of the device according to the invention is shown in detail.

The device comprises a housing 16, preferably of metal sheets 19, and a damper 6 within said housing. The damper 6 preferably is made of sheet metal and supported at its upper side in the upper corners of the housing 16 on an axle 18. The damper 6 further is supported to rotate about the axle 18, between a first end or limit position *6a*, in which the damper is shown in solid lines drawn in the FIGS. 3 and 4, and a second end or limit position *6b*, in which the damper 6 is shown by phantom lines in FIGS. 3 and 4.

The damper 6 is located in a vertical plane when assuming its second end position *6b*, and it is located in a plane forming an angle with the vertical plane when it assumes its first end position *6a*.

A handle 17 is rigidly connected to said axle 18, so that the handle too can assume two positions *17a*, *17b* corresponding to said damper end positions *6a*, *6b*. The device further comprises a sheet metal screen 20 projecting substantially horizontally from the upper portion of the device.

As described above, when the damper 6 assumes its first end position *6a*, the heated air is passed from the room 12 via the housing 16 of the device through an opening 4 into a secondary plenum 27 communicating with the air distribution passages 13, and when the damper 6 assumes its second end position *6b*, the heated air is passed from the room 12 via the housing 16 of the device to the room where the fireplace is located, via an opening formed by the upper edge of the wall 19 of the housing and said sheet metal screen 20.

The outlet opening 2 from the plenum room 12 opens into the housing 16 of device 1 in the lower portion thereof, whereby an air stream 14 advanced by the fan actuates the damper by a force so directed that the damper after having been moved manually to the first end position *6a* is retained in that position. The damper 6 is moved manually to said position by the handle 17 after the fan had been started. Said force consists of the difference in air pressure within the housing 16 near the damper 6 and the air pressure in the opening 5. When the fan ceases to operate in normal manner, for example because of current interruption, the air pressure in the housing 16 drops, and the damper 6 by action of gravity is moved to its second end position 6*b*. A disturbance in the fan operation causing the fan to operate slower or to stop gives rise to a rapid increase of the air temperature in the heat exchanger. When the fan has stopped, the air by action of self-flow will reach the housing 16, but it does not pass into the distribution system via the passages 13 but, instead, passes out through the opening 5 on the frontside of the device into the room where the open fireplace is located.

The heat-emitting surfaces of the heat exchanger and the capacity of the heat source being known in relation to different utilization degrees of the fan, the air flow through the heat exchanger is a measure of the air temperature. The damper 6 is adapted, by adjusting its weight, to assume the second position 6*b* when the air flow, and therewith the air pressure in the housing 16, has dropped to a certain level. Due to the fact, that the air temperature increases when the air flow decreases, the damper 6 at a certain air temperature will assume said second position 6*b*.

The device according to the invention, thus, prevents air with a temperature exceeding a predetermined temperature to pass into the distribution passages.

A second embodiment of the device according to the invention is shown in FIG. 4.

According to this embodiment, a locking structure 20 is provided, which comprises a bimetal spring 21 and locks the damper 6 in its first end position 6*a* when the air temperature in the device 1 drops below said predetermined value, and which releases the damper when the air temperature exceeds said value. A spring 22 further is provided to produce on the damper 6 a spring force so directed, that the damper is moved to its second end position 6*b* when said locking means 20 releases the damper 6 from its first end position 6*a*. The spring 22 preferably is a helical spring connected to the axle 18, about which the damper 6 is attached. The carrier means 23 with the bimetal spring 21 is so oriented and so secured in the wall 19 of the house 16, that one short side 24 of the bimetal spring 21 abuts the lower edge 25 of the damper 6 when the bimetal spring 21 has a temperature falling below said predetermined value, and the damper 6 assumes its first end position 6*a*. When the bimetal spring 21 is heated to a temperature above said predetermined value, because the operation of the fan is reduced and thereby the air temperature in the housing 16 increases, the bimetal spring 21 is bent in such a direction that its said short side 24 is moved away from said lower edge 25 of the damper 6 and will be located outside said lower edge 25, whereby the damper 6 is released from the locking means 20. As already mentioned, the damper 6 by action of the force of the spring 22 thereby is moved to its second end position 6*b*.

The two embodiments have in common that the position of the damper 6 at the starting of the fan shall be the first end position 6*a*, and that a return of the damper 6 to the first end position 6*a* from its second end position 6*b* requires an intentional active action such as to move the handle 17 to its position 17*a* corresponding to the first position 6*a* of the damper 6.

A third embodiment of the invention is shown in FIG. 5. According to this embodiment, the damper device 1 is located at the front wall of the fireplace 10 which in FIG. 5 is designated by 28. The device 1 is so positioned, that the inlet opening 2 to the damper device from the plenum room 12 is located below a horizontal wall 26, and the outlet opening 4 from the damper device is located above said horizontal wall 26 Wall 26 separates plenum room 12 from the secondary plenum room 27 thereabove from which heated air flows into the distribution passages 13.

The damper 29 is a substantially rectangular metal sheet with a length substantially corresponding to the width of the front wall 28 of the fireplace 10. In FIG. 5 a cross-section of the device is shown. The damper 29 is rotatably suspended about a horizontal axle 30, which is located symmetrically relative to the damper. Beneath the axle 30, on the damper an attachment bracket 31 is provided, in which a helical spring 32*a* and a rod 32 associated with a thermostat means 33 is attached. The helical spring 32*a* is fastened at its other end in a portion 34 projecting inward from the front wall 28 of the fireplace 10. The helical spring is arranged so as to be tightened when the damper 29 is in its second end position 29*b*, as indicated by dashed lines in FIG. 5. The rod 32 is attached to a helical spring 35, which in its turn is fastened in an axle 36 comprised in the thermostat device 33. The thermostat device 33 shown in FIG. 5 is of wax type, i.e., the same type as used in cooling systems of motorcars, and arranged so that at a predetermined temperature, for example 80° C., the axle 36 is pressed out from the device 33 to such an extent, that a plate 37 is caused to abut a stop member 38 at the outer end of a cylindric sleeve 39, which is attached to the thermostat device 33. At a lower temperature the axle 36 is retracted into the device 33 to a position corresponding to that shown in FIG. 5. The damper 29, thus, assumes its first end position 29*a*, shown by fully drawn lines in FIG. 5, when the temperature falls below a predetermined level. The damper 29, by action of the thermostat device via the axle 36, spring 35 and rod 36, is turned about its suspension axle 30 to its second end position 29*b* when the temperature exceeds the predetermined level. The helical spring 32, thus, has a spring force lower than the active force of the thermostat device. The helical spring 32 serves as an auxiliary means for returning the damper to its first end position when the temperature has dropped below the predetermined level.

Sealings 40, 41 are provided in connection to the front wall 28 of the fireplace to seal between the damper 29 and the front wall 28 when the damper is in its first end position, and a sealing 42 is provided to seal between the inner edge of the damper and an extension piece of the horizontal wall 26 when the damper is in its second end position. When the damper is in its first end position, heated air flows into the damper device 1 via the opening 2 and out of the device via the opening 4 and further to the distribution passages 13, as shown by the arrows 14.

When the damper is in its second end position, the air flowing through the opening 2 is led by action of the lower surface of the damper 29 out into the room where the fireplace 10 is located, as shown by the dashed arrow 15. Room air thereby flows in through the opening formed above the axle 30 of the damper and is passed on via the opening 4 to the distribution passages, as indicated by the dashed arrow 43. According to this embodiment, thus, it is achieved that the damper 29 in its second end position shuts the connection between the heat exchanger and the distribution passages 13, opens a connection between the heat exchanger and the room, in which the fireplace is located, and opens a connection between said room and the distribution passages. Due to the fact, that the room air is passed into the fireplace when the damper is in its second end position, the thermostat device 33 is cooled. As a result thereof, the damper returns to its first end position. The damper, however, will start returning to its second end position, provided that the hot air conducted past the thermostat device 33, as shown by the arrows 14, has a temperature above the predetermined level. In this way a rapid return of the damper 29 and a continued normal operation of the fireplace is obtained when the temperature of the air drops to a level below the predetermined one.

At the lastmentioned embodiment, the thermostat device 33, instead of being of wax type, may be a bimetal device or a temperature sensing member controlling an electric motor for movement of the damper 29.

A further advantage of the device according to the invention is, that the hot air is passed downward in the room where the fireplace is located, when the damper is in its second end position, Consequently, the hot air rapidly is mixed with the colder room air, because the hot air after having been pressed down arises freely through the room air.

The hot air flow, as mentioned above, instead of being passed out into the room where the fireplace is located, can be passed into a space safe for high temperatures. One example of such a space is the hearth. In this case a passage is connected from the opening 5 according to FIGS. 3, 4 and 5 to said space. As regards the third embodiment, the passage preferably is designed so that the outer portion of the damper 29 abuts the outer wall of said lastmentioned passage, and is sealed against the same when the damper is in its second end position. The inner wall of said lastmentioned passage preferably consists of the front wall 28 of the fireplace.

Such modifications with respect to the transport of the hot air, which by the damper was shut off from the distribution passages, are comprised within the scope of the present invention.

As appears from the above description, the device according to the present invention ensures that air with too high a temperature is not permitted to pass into the distribution passages 13, but is led out into the room where the fireplace is located or into another space safe for high temperatures. In spite of its simple design, thus, the device according to the invention offers very great advantages as regards safety against overheating in the distribution passages when an open fireplace with distribution passages of the kind described here is used.

The invention is not restricted to the embodiments described above, but can be modified within the scope of the attached claims.

What I claim is:

1. An airflow control device for use with an open fireplace structure which includes a heat exchanger having an inlet and an outlet, an electric fan device to force air through the heat exchanger, a first plenum receiving heated air from the outlet of the heat exchanger and an air distribution system including a second plenum, with air distribution outlet passages, adjacent the first plenum arrangement, said airflow control device adapted to be mounted between the two plenums for controlling and directing heated air from the first plenum to the second plenum and to by-pass heated air from the first plenum into fluid communication with a space safe for high temperature air, said device comprising: a chamber having openings in fluid flow communication with said first and second plenums and with said safe high temperature space; a rotatable sheet material damper; an axle means pivotally mounting said damper in said chamber and enabling said damper to assume a first and a second end limit position; whereby said damper in said second limit position prevents the heat exchanger outlet air stream from passing from the first plenum through the chamber to the second plenum and its air distribution passages, and by-passes the heat exchanger outlet air stream out through the chamber to the safe high temperature space; and whereby said damper in its first limit position provides an airflow path from the first plenum to the second plenum and prevents airflow out to the safe high temperature space; said damper device having condition responsive means, including said damper, responsive to a heating air condition indicative of excess temperature in the air distribution system, controlling and at least moving said damper from its said first end limit position to its said second end limit position.

2. A device according to claim 1, wherein said damper is supported on said axle adjacent its upper end, and in its second limit position it is in a vertical plane, and in its first limit position it is in a plane forming an angle with the vertical plane, and wherein the opening in said chamber in fluid communication with the first plenum is so located in relation to the damper that the air flow into said chamber caused by the fan acts upon the damper with a force so directed that the damper when placed in the first position is retained in said first position, and that the damper, when such air flow force produced by the fan ceases, is moved by gravity action to the second limit position.

3. A device according to claim 2, said condition responsive means including a locking means comprising a bimetal spring mounted to lock the damper in said first end limit position when the air temperature in the device falls below a predetermined value, and to release the damper when the air temperature exceeds said predetermined value; and wherein a spring is connected to bias the damper toward and move it to its second end limit position when said locking means releases the damper from its first end limit position.

4. A device according to claim 1, wherein said damper is rotatable about its longitudinal axis on its axle on a horizontal axis, and wherein the damper in its first end position is located in a vertical position coinciding substantially with the front wall of the fireplace, and in its second end position is located in a plane forming an angle with the vertical plane, in such a manner, that its inner horizontal edge sealingly abuts a wall, which separates the first plenum from the second plenum and the damper, in its second end position, in addition to preventing the air stream from passing to the distribution air passages and permitting the air stream to pass to said safe space, opens a connection between the safe space, in which the fireplace is located, and the distribution passages; and including a thermostat device connected to said damper to effect a damper movement when the air temperature exceeds a predetermined value, such that the damper is moved from its first end limit position, and that said thermostat device is disposed in a location to be subject to flow of air from said safe space when the damper is in its second end limit position.

5. A device according to claim 4, wherein said thermostat device is positioned at the opening from the device to the second plenum for obtaining cooling of the thermostat device when the damper is in its second end limit position.

6. A device according to claim 4, wherein said thermostat device is a thermostat with wax type, temperature responsive means.

7. A device according to claim 4, wherein said thermostat device is a device comprising a bimetal spring.

8. A device according to claim 1, wherein said second end limit position of said damper is located so that the outflowing air from said chamber is directed downward.

9. A device according to claim 1, wherein a passage is provided between said device and the hearth of the fireplace for transporting the heated air to the hearth of the fireplace when the damper has assumed its second end position.

* * * * *

UNITED STATES PATENT AND TRADEMARK OFFICE

CERTIFICATE OF CORRECTION

PATENT NO. : 4,154,215

DATED : May 15, 1979

INVENTOR(S) : Lars Tjernstrom

It is certified that error appears in the above-identified patent and that said Letters Patent are hereby corrected as shown below:

Column 2, line 12, after "fan" insert --8--.

Column 2, lines 14 and 15, cancel "is designated by"

Column 4, line 3, after "wall 26" (1st instance) insert a --period--.

Column 5, line 21, after "position", change the comma (,) to a period (.)

Signed and Sealed this

*Twenty-fifth* Day of *September 1979*

[SEAL]

*Attest:*

*Attesting Officer*

LUTRELLE F. PARKER

*Acting Commissioner of Patents and Trademarks*